US007578284B2

(12) United States Patent
Mayuzumi et al.

(10) Patent No.: US 7,578,284 B2
(45) Date of Patent: Aug. 25, 2009

(54) INTERNAL COMBUSTION ENGINE CONTROLLER

(75) Inventors: Takuya Mayuzumi, Hitachinaka (JP); Mitsuhiko Watanabe, Odawara (JP); Ryoichi Oura, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 72 days.

(21) Appl. No.: 11/958,096

(22) Filed: Dec. 17, 2007

(65) Prior Publication Data

US 2008/0289607 A1 Nov. 27, 2008

(30) Foreign Application Priority Data

Jan. 12, 2007 (JP) ..... 2007-003973

(51) Int. Cl.
*F02D 41/02* (2006.01)
*F02M 51/00* (2006.01)

(52) U.S. Cl. ..... 123/490

(58) Field of Classification Search ..... 123/490, 123/478, 480, 456; 701/103–105
See application file for complete search history.

(56) References Cited

U.S. PATENT DOCUMENTS 5,752,482 A * 5/1998 Roettgen et al. ..... 123/322
6,308,688 B1 * 10/2001 French et al. ..... 123/490
7,377,265 B2 * 5/2008 Kojima ..... 123/490
2003/0062029 A1 4/2003 Oyama et al.

FOREIGN PATENT DOCUMENTS

JP 2001-14045 A 1/2001
JP 2002-61534 A 2/2002
JP 2003-106200 A 4/2003

OTHER PUBLICATIONS

Japanese Office Action dated May 12, 2009 (Three (3) pages).

* cited by examiner

*Primary Examiner*—Hieu T Vo
(74) *Attorney, Agent, or Firm*—Crowell & Moring LLP

(57) ABSTRACT

An internal combustion engine controller has: a voltage booster circuit for boosting a battery power source; a booster side driver element for flowing a current through the injectors by using the boosted voltage; a battery side driver element disposed in parallel with the booster side driver element to flow a current through the injectors by using the battery power source; a first downstream side driver element provided by controlling currents flowing through the injectors; current regeneration diodes for flowing currents from the downstream side to the upstream side of the injectors; a booster side current detector resistor for detecting currents flowing via the current regeneration diodes; and an injector control circuit for controlling and driving the booster side driver element, battery side driver element and first downstream side driver element.

19 Claims, 9 Drawing Sheets

INTERNAL COMBUSTION ENGINE CONTROLLER

BACKGROUND OF THE INVENTION

The present invention relates to an internal combustion engine controller for driving a load by using a high voltage obtained by boosting a battery voltage, and more particularly to an internal combustion engine controller suitable for driving a cylinder direct injection type injector.

For the purposes of improving a fuel consumption and an output, an injector for directly injecting fuel in a cylinder is used with an internal combustion engine controller of an engine using gasoline, gas oil or the like as its fuel, such as those of automobiles, auto-bikes, agricultural tractors, machine tools, and marine vessels. An injector of this type is called "cylinder direct injection type injector, "direct injector", or simply "DI".

As compared to a premix type engine which is the main stream of gasoline engines, forms mixture gas of air and fuel in advance and introduces the mixture gas into a cylinder, an engine utilizing a cylinder direct injection type injector is required to provide larger energy when opening a valve of the injector, because the engine uses fuel pressurized to a high pressure. It is also necessary to supply a large current to the injector in a short time, in order to improve controllability and realize high speed.

Most of conventional internal combustion engine controllers controlling a cylinder direct injection type injector are provided with a voltage booster circuit for boosting a battery voltage to a higher voltage and making the voltage boosted by the voltage booster circuit increase an exciting current to the injector in a short time.

A drive current waveform for a typical direct injector uses a boosted voltage during a peak current exciting period at an initial exciting stage to increase an injector current to a predetermined peak stop current in a short time. This peak current is about five to ten times an injector current of the premix type engine which introduces a mixture gas of fuel and air into the cylinder.

After the peak current exciting period, an energy supply source for the injector transits from the boosted voltage to the battery power source. The injector current transits, via a first hold current controlled by a first hold stop current about a half to one thirds of the peak current, to a second hold current controlled by a second hold stop current about two thirds to a half of the second hold current. The peak current and first hold current open the valve of the injector and inject the fuel into the cylinder.

In order to close the valve of the injector immediately after injection, it is necessary to complete an exciting current reduction period of the injector exciting current in a short time to cut off the injector current.

However, large energy is accumulated in the injector because of a flow of the injector current. In order to cut off the injector current, it is necessary to extinguish this energy from the injector. In order to realize this in a short time during the exciting current reduction period, various methods have been adopted including a method of converting energy into thermal energy by driver elements of a driver circuit for driving the injector current by utilizing the Zener diode effects and a method of regenerating the injector current to a voltage booster capacitor of the voltage booster circuit for accumulating a boosted voltage.

With the former method, although the driver circuit can be simplified, this method is not suitable for a large current driver circuit because the injector exciting energy is converted into thermal energy. In contrast, with the latter method, even if a large current is flowed to the injector, heat generation of the driver circuit can be suppressed relatively. Therefore, this method is widely used particularly for an engine using a direct injection injector using gas oil (called also common rail engine) and an engine using a direct injection injector using gasoline as fuel (called also DIG or GDI), which require a large exciting current to the engine.

During the period of reducing the injector current, the injector current is reduced in a short time in some cases also during the exciting current reduction period, a peak current reduction period and a first hold current reduction period. Similar to the exciting current reduction period, the operation of the injector driver circuit is performed during these periods by turning off all of a voltage booster side FET, a battery side driver FET and a first downstream side driver FET.

SUMMARY OF THE INVENTION

With the former method, as disclosed in Japanese Patent Unexamined Publication No. 2003-106200, current exciting energy in the injector is converted into thermal energy by utilizing the Zener diode effects of a first downstream side driver FET. In this case, similar to the other current excitation periods, the injector current can be detected with a downstream side current detector resistor serially connected to the first downstream side driver FET so that the injector control circuit can perform precise current control.

In contrast, the latter method regenerates electric energy of the injector to the voltage booster circuit via a current regeneration diode connected between the downstream side of the injector and the voltage booster circuit. It is therefore possible to suppress heat generation relatively, even if a large current is flowed through the injector. However, in this case, since the first downstream side driver FET is perfectly turned off, the injector current cannot be detected with the downstream side current detector resistor serially connected to the first downstream side drive FET, similar to the other current excitation periods.

In order to realize precise current control during a period while the injector current is reduced in a short time by regenerating electric energy of the injector to the voltage booster circuit via the current regeneration diode, the current is required to be detected at the position different from that of the downstream side current detector resistor, similar to the other current excitation periods.

An object of the present invention is to perform precise current control even during a period while the injector current is reduced in a short time by regenerating electric energy of the injector to the voltage booster circuit. More preferably, an object of the present invention is to realize short time current reduction without changing the structure and characteristics of a conventional injector driver circuit.

Still another object of the present invention is to provide an internal combustion engine controller having a driver circuit capable of reducing the number of components to be added to detect a regeneration current to the voltage booster circuit.

In order to solve the above problems, a typical embodiment of the present invention provides an internal combustion engine controller comprising: a voltage booster circuit for boosting a battery voltage and outputting a boosted voltage; a first switching element (booster side drive FET 202) disposed on an upstream side along a current direction of an injector, the first switching element flowing a current through the injector by using the boosted voltage; a second switching element (battery side driver FET 212) disposed in parallel to the first switching element on the upstream side along a current direction of the injector, the second switching element flowing a current through the injector by using the battery voltage; a third switching element (first downstream side driver FET 220-1) disposed on a downstream side along a current direction of the injector, the third switching element controlling a current flowing through the injector; a first resistor (downstream side current detector resistor 221) disposed between the third switching element and a power source ground terminal, the first resistor detecting a current flowing through the injector; a first diode (current regeneration diode 2-1) for flowing a current from the downstream side to the upstream side of the injector; a second resistor (booster side current detector resistor 201) for detecting a current flowing via the first diode; and a driver control unit (injector controller 240) for controlling and driving the first, second and third switching elements.

Another typical embodiment of the present invention provides an internal combustion engine controller comprising: a voltage booster circuit for boosting a battery voltage and outputting a boosted voltage; a first switching element disposed on an upstream side along a current direction of an injector, the first switching element flowing a current through the injector by using the boosted voltage; a second switching element disposed in parallel with the first switching element on the upstream side along a current direction of the injector, the second switching element flowing a current through the injector by using the battery voltage; a third switching element disposed on a downstream side along a current direction of the injector, the third switching element controlling a current flowing through the injector; a resistor (first injector downstream side current detector resistor 223-1, injector upstream side current detector resistor 225) serially connected to the injector, the resistor detecting a current flowing through the injector; a current detector circuit for detecting a current flowing through the resistor; and a driver control unit for controlling and driving the first, second and third switching elements.

According to the present invention, it is possible to provide an internal combustion engine controller having high reliability.

Other objects, features and advantages of the invention will become apparent from the following description of the embodiments of the invention taken in conjunction with the accompanying drawings.

DESCRIPTION OF THE EMBODIMENTS

Embodiments of the present invention will now be described in detail with reference to the accompanying drawings.

First Embodiment

Figure 1:
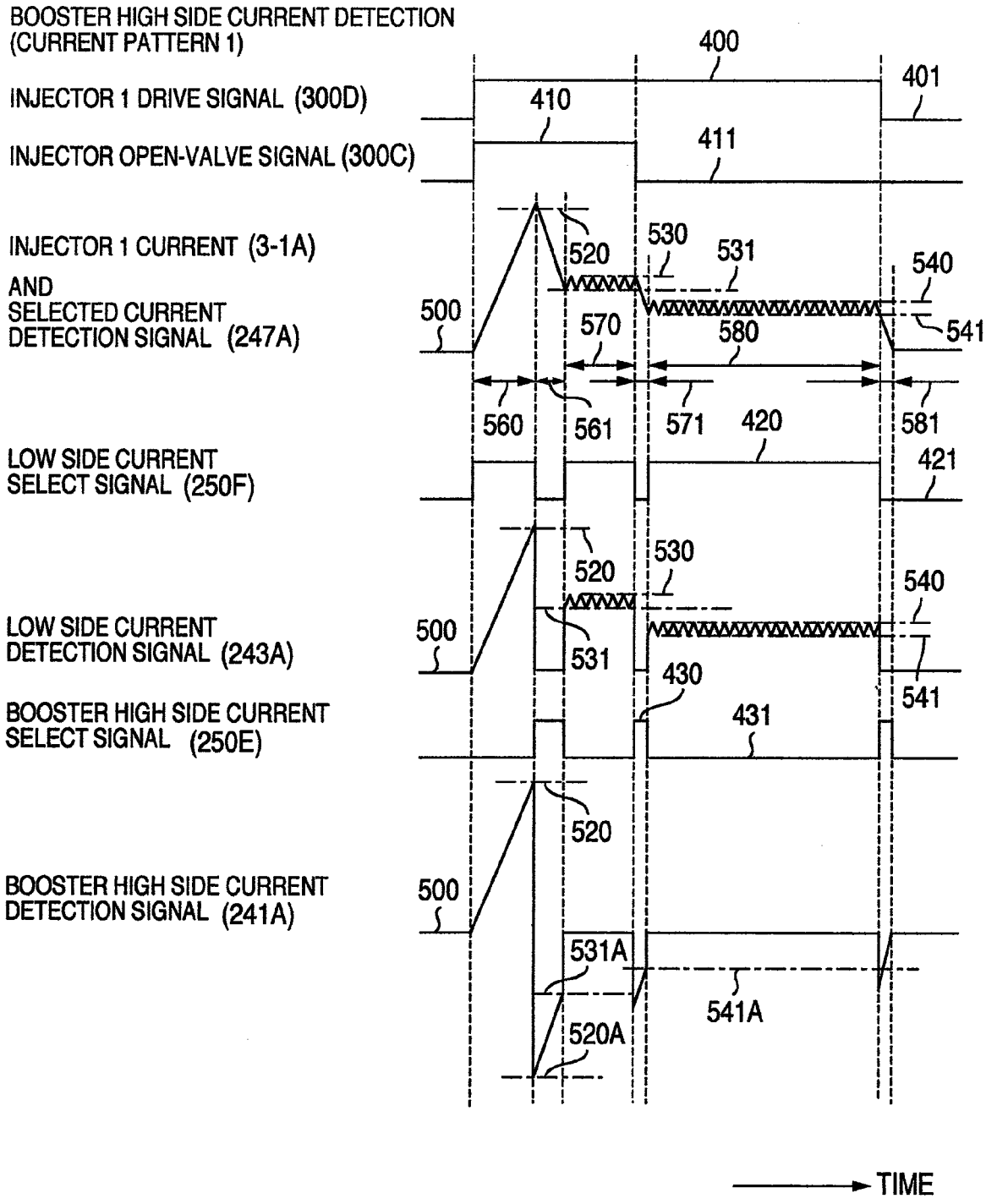
FIG. 1 is a diagram showing the current waveforms of an internal combustion engine controller according to a first embodiment of the present invention.
Figure 2:
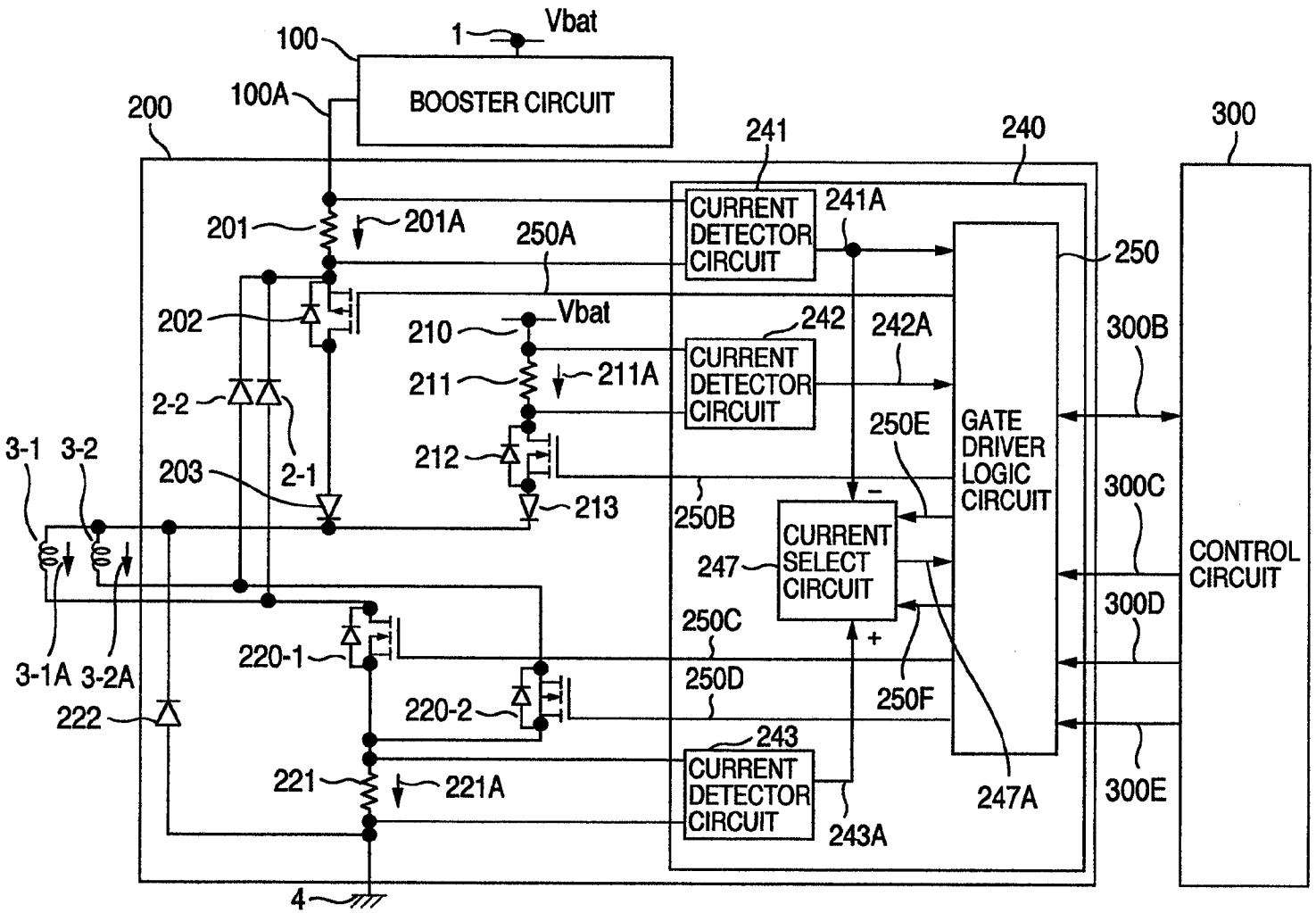
FIG. 2 is a diagram showing an injector driver circuit of the internal combustion engine controller according to the first embodiment of the present invention.
Figure 8:
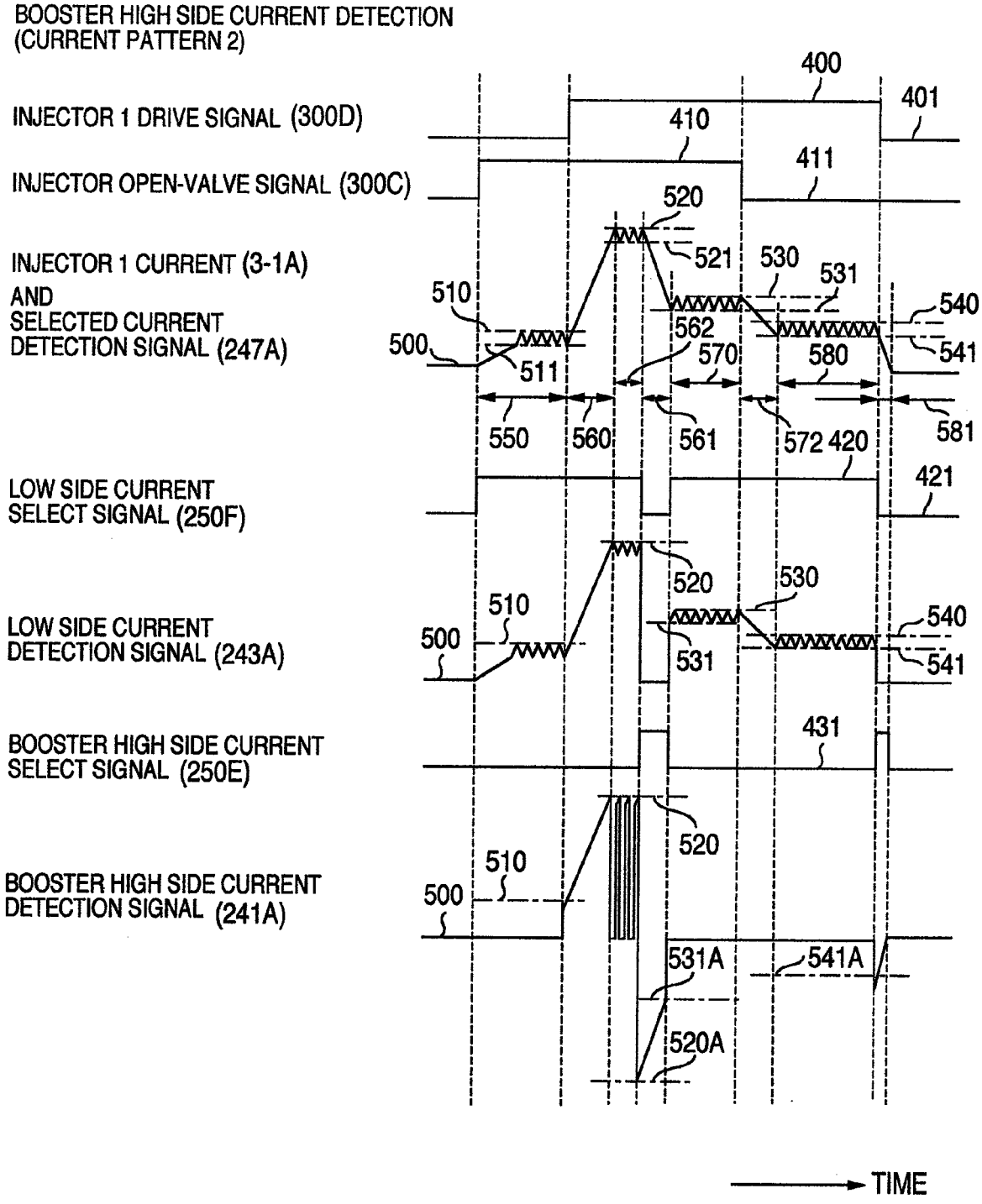
FIG. 8 is a diagram showing the current waveforms of the internal combustion engine controller according to the first embodiment of the present invention.
Figure 9:
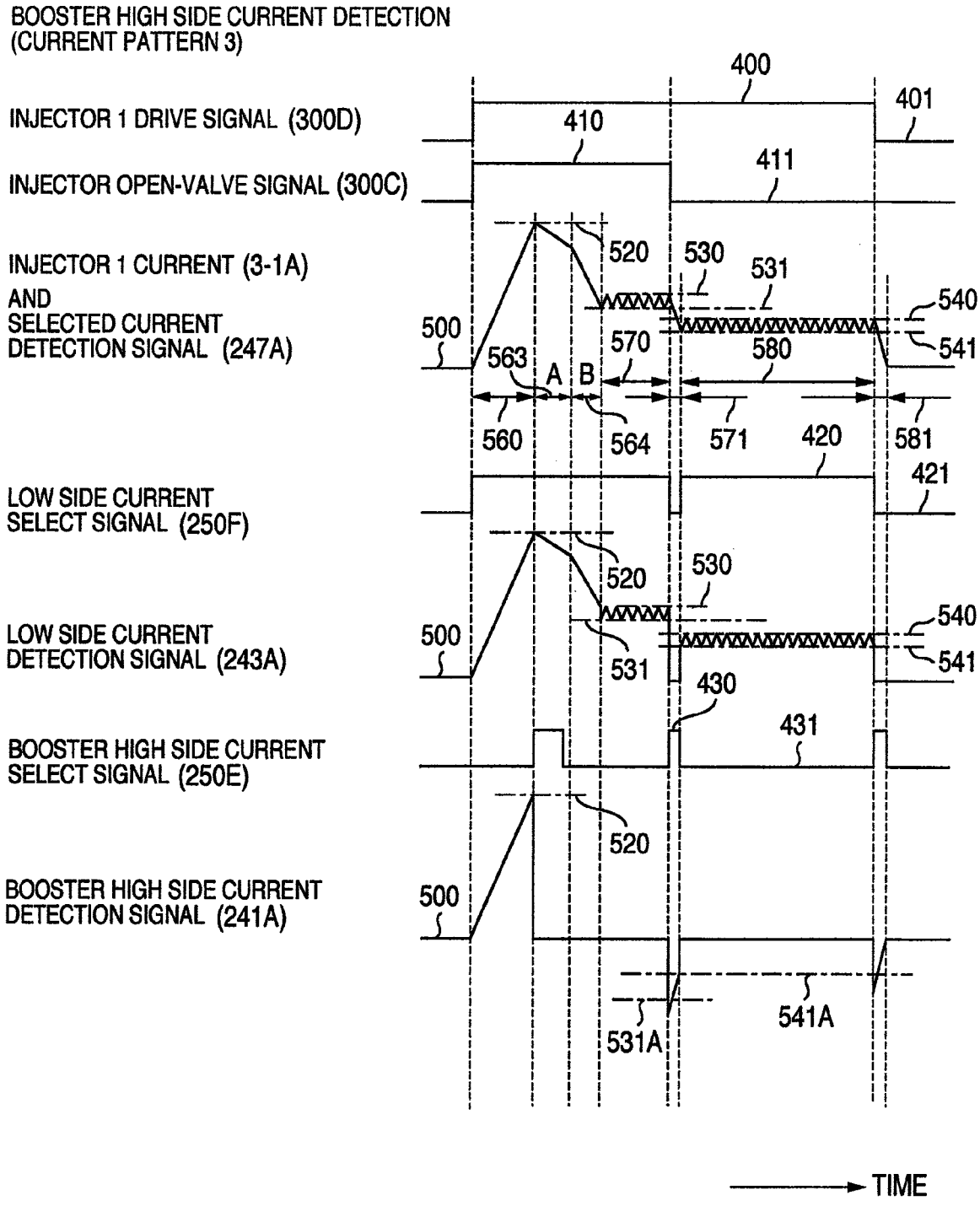
FIG. 9 is a diagram showing the current waveforms of the internal combustion engine controller according to the first embodiment of the present invention.

FIG. 2 is a diagram showing the structure of the internal combustion engine controller according to the first embodiment of the present invention. Typical current waveforms of the internal combustion engine controller are shown in FIGS. 1, 8 and 9.

The internal combustion engine controller of the embodiment has a driver circuit 200 for driving a plurality of injectors 3-1 and 3-2.

Generally, in the direct injection injectors using a boosted voltage 100A obtained by boosting a voltage of a battery power source (Vbat) 1 by a voltage booster circuit 100, the plurality of injectors 3-1 and 3-2 share the driver circuit 200. An actual internal combustion engine controller is applied to, for example, an engine having four to eight cylinders. The driver circuit 200 can drive a plurality of injectors. In the example shown in FIG. 2, the driver circuit 200 is used for two injectors 3-1 and 3-2.

The voltage booster circuit 100 is shared by a plurality of driver circuits 200. Each engine mounts usually one to four voltage booster circuits 100. The number of driver circuits 200 shared by the voltage booster circuit 100 is determined by an energy necessary for exciting injector currents 3-1A and 3-2A shown in FIG. 2 during a peak current exciting period 560, a maximum engine speed, and a voltage booster recovery period and self heat generation of the booster circuit 100 determined from the number of fuel injection times of each injector per one combustion in the same cylinder, and the like.

A boosted voltage 100A boosted by the voltage booster circuit 100 is applied to the upstream side (along a current flow direction of the injectors) of the injectors 3-1 and 3-2, via a booster side current detector resistor 201, a booster side driver FET 202 and a booster side protective diode 203. The booster side detector resistor 201 converts a booster side drive current 201A into a voltage, and is used for detecting an overcurrent outflowing from the voltage booster circuit 100 or a harness disconnection and the like on the side of the injectors 3-1 and 3-2. The booster side driver FET 202 drives injector currents 3-1A and 3-2A to be described later, during a peak current exciting period 560. The booster side protective diode 203 prevents a reverse current to be generated when the voltage booster circuit 100 is broken.

A voltage of a battery power source (Vba) 210 is applied to the upstream side of the injectors 3-1 and 3-2 via a battery side current detector resistor 211, a battery side driver FET 212 and a battery side protective diode 213. The battery side detector resistor 211 converts a battery side drive current 211A into a voltage, and is used for detecting an overcurrent outflowing from the battery power source 210 or a harness disconnection and the like on the side of the injectors 3-1 and 3-2.

The battery side driver FET 212 is driven to flow first and second hold currents of the injector currents 3-1A and 3-2A. The first and second hold currents flow respectively during a first hold current period 570 and a second hold current period 580 shown in FIG. 1 and other drawings. The battery side protective diode 213 is provided in order to prevent a current generated by the boosted voltage 100A from reversely flowing toward the battery power source 210.

The injectors 3-1 and 3-2 are connected respectively to a first downstream side (along a current flowing direction) driver FET 220-1 and a second downstream side driver FET 220-2. The injectors 3-1 and 3-2 are selectively excited by the switching operation of the first and second downstream side driver FET's 220-1 and 220-2.

The injector currents 3-1A and 3-2A flowing through the injectors 3-1 and 3-2 are drained to a power source ground 4 via a downstream side current detector resistor 221 for converting a current into a voltage, via the source electrodes of the first and second downstream side driver FET's 220-1 and 220-2.

A current circulating diode 222 is provided between the upstream side of the injectors 3-1 and 3-2 and power source ground 4. While the injector currents 3-1A and 3-2A are excited, the booster side drive FET 202 and battery side drive FET 212 are turned off at the same time to circulate an injector regeneration current generated by turning on one of the first downstream side driver FET 220-1 and second downstream side driver FET 220-2. Therefore, an anode of the current circulating diode 222 is connected to the power source ground 4 and a cathode thereof is connected to the upstream side of the injectors 3-1 and 3-2.

Current regeneration diodes 2-1 and 2-2 are provided between the downstream side of the injectors 3-1 and 3-2 and a path on the booster voltage side. In this embodiment, an anode of the current regeneration diode 2-1 is connected to a path between the injector 3-1 and first downstream side driver FET 220-1, and a cathode thereof is connected to a path between the booster side current detector resistor 201 and booster side driver FET 202. Similarly, an anode of the current regeneration diode 2-2 is connected to a path between the injector 3-2 and second downstream side driver FET 220-2, and a cathode thereof is connected to a path between the booster side current detector resistor 201 and booster side driver FET 202. The reason why these current regeneration diodes 2-1 and 2-2 are provided is that while the injector currents 3-1A and 3-2A are excited, the booster side driver FET 202 and battery side driver FET 212 on the upstream side and the first downstream side driver FET 220-1 and second downstream side driver FET 220-2 are all turned off to regenerate electric energy of the selected injectors 3-1 and 3-2 to the voltage booster circuit 100.

The driver FET's including the booster side driver FET 202, battery side driver FET 212, first downstream side driver FET 220-1 and second downstream side driver FET 220-2 are controlled by an injector open-valve signal 300C, a first injector drive signal 300D and a second injector drive signal 300E supplied from a control circuit 300, in accordance with an engine speed and input conditions supplied from various sensors.

An injector control circuit 240 has: a booster side current detector circuit 241 for detecting a booster side drive current 201A flowing through a booster side current detector resistor 201; a battery side current detector circuit 242 for detecting a battery side drive current 211A flowing through a battery side current detector resistor 211; a downstream side current detector circuit 243 for detecting a downstream side drive current 221A flowing through a downstream side current detector resistor 221; a current select circuit 247 for selecting a current detected by the current detector circuit 241 or current detector circuit 243; and a gate drive logic circuit 250.

The gate drive logic circuit 250 generates: a booster side driver FET control signal 250A; a battery side driver FET control signal 250B; a first downstream side driver FET control signal 250C and a second downstream side driver FET control signal 250D, in accordance with the values (a booster side current detection signal 241A, a battery side current detection signal 242A, a low side current detection signal 243A) detected by the booster side current detector circuit 241, battery side current detector circuit 242 and downstream side current detector circuit 243, respectively.

The control circuit 300 and injector control circuit 240 exchange necessary information on control signals of the injector control circuit 240 itself, by using a communication signal 300B between the driver circuit 200 and control circuit 300. The necessary information includes a precharge stop current 510, a precharge stop current 511, a peak stop current 520, a first hold start current 530, a first hold start current 531, a second hold stop current 540, a second hold start current 541, a peak current hold period 562, a peak current gentle A reduction period 563, a first hold current period 570, and a second hold current period 580, respectively for determining injector drive waveforms, and diagnosis results such as presence/absence of a precharge current, presence/absence of execution of peak current hold, presence/absence of execution of peak current gentle A, switching of steep/gentle of a peak current rise, presence/absence of peak current gentle A, switching of steep/gentle of a peak current fall, presence/absence of a first hold current, switching of steep/gentle of a first hold current fall, detection of an overcurrent, detection of a disconnection, protection from excessive heat, a failure of the voltage booster circuit, and the like thereby to control the engine and the other components associated to the engine.

Typical current waveforms of the direct injection injector for the driver circuit 200 described above are shown in FIG. 1. The current waveforms shown in FIG. 1 are obtained through booster high side current detection (current pattern 1).

The waveform of the injector current 3-1A will be described divisionally for six periods including the peak current exciting period 560, a peak current steep reduction period 561, the first hold current period 570, a first hold current steep reduction period 571, the second hold current period 580 and an exciting current reduction period 581 (description of the injector current 3-2A is omitted because the injector current 3-2A is similar to the injector current 3-1A).

First, when the injector drive signal 300D turns on (a first injector exciting signal 400) and the injector open-valve signal 300C turns on (an injector open-valve current excitation signal 410), the peak current exciting period 560 starts. During this period, the boosted voltage 100A boosted by the voltage booster circuit 100 increases the injector current 3-1A to a predetermined peak stop current 520 in a short time. In this case, the gate driver logic circuit 250 outputs a booster side driver FET control signal 250A and a first downstream driver FET control signal 250C to turn on both the booster side driver FET 202 and first downstream side driver FET 220-1. Therefore, the injector current 3-1A changes steeply from zero (a power source ground voltage 500) to the peak stop current 520.

In this case, a low side current select signal 250F turns on (a low side current select ON signal 420) and a booster high side current select signal 250E turns off (a booster side high side current select OFF signal 431). Therefore, the current select circuit 247 selects a low side current detection signal 243A output from the current detector circuit 243. During this period, a selected current detection signal 247A is therefore the low side current detection signal 243A based on a downstream side drive current 221A flowing through the downstream current detector resistor 221. The peak stop current 520 is about five to twenty times an injector current of the premix type engine which introduces a mixture gas of fuel and air into the cylinder.

As the injector current 3-1A reaches the predetermined peak stop current 520, the peak current steep reduction period 561 enters. During this period, both the booster side driver FET 202 and first downstream side driver FET 220-1 are controlled to be turned off. Therefore, a current flowing through the injector 3-1 lowers steeply.

Since both the booster side driver FET 202 and first downstream side driver FET 220-1 are turned off, a current will not flow through the first downstream side current detector resistor 221 and the injector current 3-1A cannot be detected with the resistor 221.

During this period, therefore, the low side current select signal 250F is controlled to be turned off (a low side current select OFF signal 421) and the booster high side current select signal 250E is controlled to be turned on (a booster high side current select ON signal 430). With this control, the current selector circuit 247 detects a current flowing through the booster side current detector resistor 201. Since the injector current 3-1A flows through the booster side current detector resistor 201 via the current regeneration diode 2-1, the current flowing through the booster side current detector resistor 201 can be detected with the current detector circuit 241.

The current flowing through the booster side current detector resistor 201 has a direction opposite to that of the current during the peak current steep reduction period 561. The injector current 3-1A can therefore be obtained by reversing the sign of the waveform of the booster high side current detection signal 241A. A peak stop reverse current 520A, a first hold start reverse current 531A and a second hold start reverse current 541A have respectively opposite signs to those of the peak stop current 520, a first hold start current 531 and a second hold start current 541.

As the injector current 3-1A reaches the first hold start current 531, the first hold current period 570 enters. During this period, the first downstream side driver FET 220-1 is controlled to be turned on and the battery side driver FET 212 is controlled to perform on/off switching. Namely, when the injector current 3-1A reaches a first hold stop current 530, the battery side driver FET 212 is controlled to be turned off, whereas when the injector current 3-1A reaches the first hold start current 531, the battery side driver FET 212 is controlled to be turned on.

In this case, the low side current selection signal 250F is turned on and the booster high side current selection signal 250E is turned off. Therefore, the injector current 3-1A is detected with the downstream current detector resistor 221.

As the injector open-valve signal 300C changes from ON to OFF (an injector open-valve signal unexcited signal 411), the first hold current steep reduction period 571 starts. During this period, both the battery side driver FET 212 and first downstream side driver FET 220-1 are controlled to be turned off. Therefore, the current flowing through the injector 3-1 lowers steeply.

In this case, the low side current selection signal 250F is tuned off and the booster high side current selection signal 250E is turned on. Therefore, the injector current 3-1A is detected with the booster high side current detector resistor 201.

As the injector current 3-1A reaches the second hold start current 541, the second hold current period 580 starts. During this period, the first downstream side driver FET 220-1 is controlled to be turned on and the battery side driver FET 212 is controlled to perform on/off switching. Namely, when the injector current 3-1A reaches a second hold stop current 540, the battery side driver FET 212 is controlled to be turned off, whereas when the injector current 3-1A reaches the second hold start current 541, the battery side driver FET 212 is controlled to be turned on.

In this case, the low side current selection signal 250F is turned on and the booster high side current selection signal 250E is turned off. Therefore, the injector current 3-1A is detected with the downstream current detector resistor 221.

As the injector drive signal 300D changes from ON to OFF (a first injector unexcited signal 401), the exciting current reduction period 581 starts. During this period, both the battery side driver FET 212 and first downstream side driver FET 220-1 are controlled to be turned off. Therefore, the current flowing through the injector 3-1 lowers steeply.

In this case, the low side current selection signal 250F is tuned off and the booster high side current selection signal 250E is turned on. Therefore, the injector current 3-1A is detected with the booster side current detector resistor 201.

As described above, after the peak current exciting period 560, an energy supply source to the injector 3-1 changes from the boosted voltage 100A to a voltage of the battery power supply 210. Therefore, the injector current changes to the first hold current controlled by the first hold stop current 530 about a half to one third of the peak current, and to the second the second hold current controlled by the second hold stop current 540 about two thirds to a half of the second hold current. The peak current and first hold current opens the valve of the injector 3-1 and inject fuel into the cylinder.

In order to quickly close the valve of the injector 3-1 after fuel injection, the exciting current reduction period 581 of the injector current 3-1A is required to be performed in a short time to cut off the injector current 3-1A.

High energy is accumulated in the injector 3-1 because the injector current 3-1A flows therethrough. In order to cut off this current, it is necessary to extinguish the energy from the injector 3-1. However, since the first downstream side driver FET 220-1 is completely turned off, the injector current 3-1 cannot be detected as the current flowing through the downstream side current detector resistor 221 serially connected to the first downstream side driver FET 220-1.

In order to settle this issue, the current regeneration diode 2-1 is provided to realize precise current control during the peak current steep reduction period 561 and the like. With this arrangement, electric energy of the injector 3-1 is regenerated to the booster circuit 100 via the current regeneration diode 2-1. The current regeneration diode 2-1 has the anode connected between the injector 3-1 and first downstream side driver FET 220-1 and the cathode connected between the booster side current detector resistor 201 and booster side driver FET 202.

The booster side current detector resistor 201 has been used conventionally only for detecting a ground short, disconnection and the like on the upstream side of the injector 3-1. In this embodiment, the current regeneration diode 2-1 is connected to the downstream side of the booster side current detector resistor 201, to use the booster side current detector resistor 201 conventionally used only for the above-described object, also for detecting a regeneration current during the peak current steep reduction period 561 and the like.

The injector current 3-1A can be controlled precisely during all current exciting periods. This arrangement can be realized without increasing the number of components used for exciting directly the injector current 3-1A.

FIG. 8 shows the typical waveforms of the injector current 3-1A (selected current detection signal 247A), different from those shown in FIG. 1, of the direct injection injector in the driver circuit 200.

The waveforms shown in FIG. 8 are obtained through booster high side current detection (current pattern 2), and are different from those shown in FIG. 1 in the following points. These modifications aim at improving the characteristics of an injector itself, suppressing circuit heat generation and improving the engine combustion characteristics, respectively during corresponding current exciting periods.

Similar to the first and second hold current periods 570 and 580, during a precharge current exciting period 550, the battery power source 210 is used. By switching the battery side driver FET 212, a path flowing a current to the power source ground 4 and a path flowing a current through the current circulating diode 222 are switched. In this case, the injector current 3-1A is controlled to have a value between the precharge stop current 510 and precharge start current 511, by using the downstream side current detector resistor 221.

During a peak current hold period 562, the boosted voltage 100A is used. By switching the booster side driver FET 202, the path flowing a current to the power source ground 4 and the path flowing a current through the current circulating diode 222 are switched. In this case, the injector current 3-1A is controlled to have a value between the peak stop current 520 and peak start current 521, by using the downstream side current detector resistor 221

During a first hold current gentle reduction period 572, the current is reduced not in a short time but gently, when the first hold current transits to the second hold current. To this end, the booster side driver FET 202 and battery side driver FET 212 are turned off, and the first downstream side drive FET 220-1 is made conductive. With this control, the injector current 3-1A is circulated via the current circulating diode 222 to control the current to reduce to the second hold start current 541, by using the detector resistor 221.

FIG. 9 shows the typical waveforms of the injector current 3-1A (selected current detection signal 247A), different from those shown in FIGS. 1 and 8, of the direct injection injector.

The waveforms shown in FIG. 9 are obtained through booster high side current detection (current pattern 3), and are different from those shown in FIGS. 1 and 8 in the following points. These modifications aim at improving the characteristics of an injector itself, suppressing circuit heat generation and improving the engine combustion characteristics, respectively during corresponding current exciting periods.

During the peak current gentle A reduction period 563, the current is reduced not in a short time but gently, when the peak current transits to the first hold current or second hold current. To this end, the battery side driver FET 212 and first downstream side drive FET 220-1 are made conductive to gently reduce the current toward a saturation current which is limited by the resistance components of the battery power source 210, injector 3-1 and driver circuit 200. During this period, usual current control is not performed, but current excitation is controlled to be performed only during a period adjusted beforehand.

During a peak current gentle B reduction period 564 after completion of the peak current gentle A reduction period 563 and when the peak current transits to the first hold current or second hold current, the current is reduced not in a short time but gently, similar to the first hold current gentle reduction period 572. To this end, the booster side driver FET 202 and battery side driver FET 212 are turned off, and the first downstream side drive FET 220-1 is made conductive. With this control, the injector current 3-1A is circulated via the current circulating diode 222 to control the current to reduce to the second hold start current 541, by using the detector resistor 221.

Second Embodiment

Figure 3:
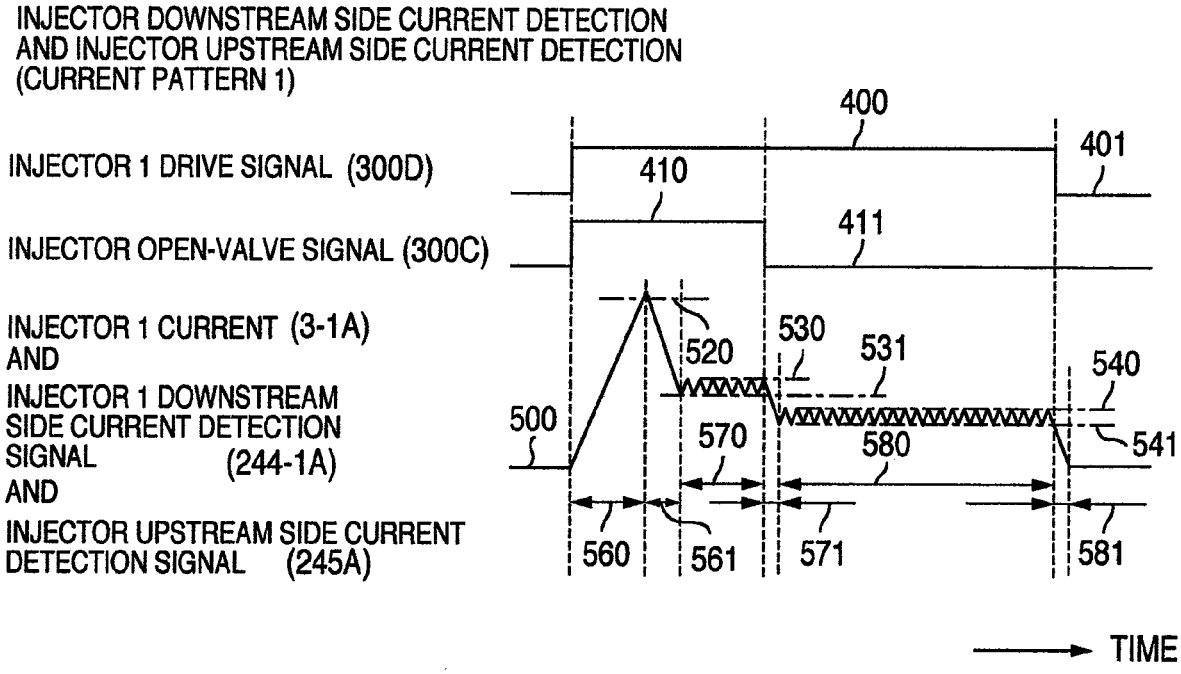
FIG. 3 is a diagram showing the current waveforms of an internal combustion engine controller according to second and third embodiments of the present invention.
Figure 4:
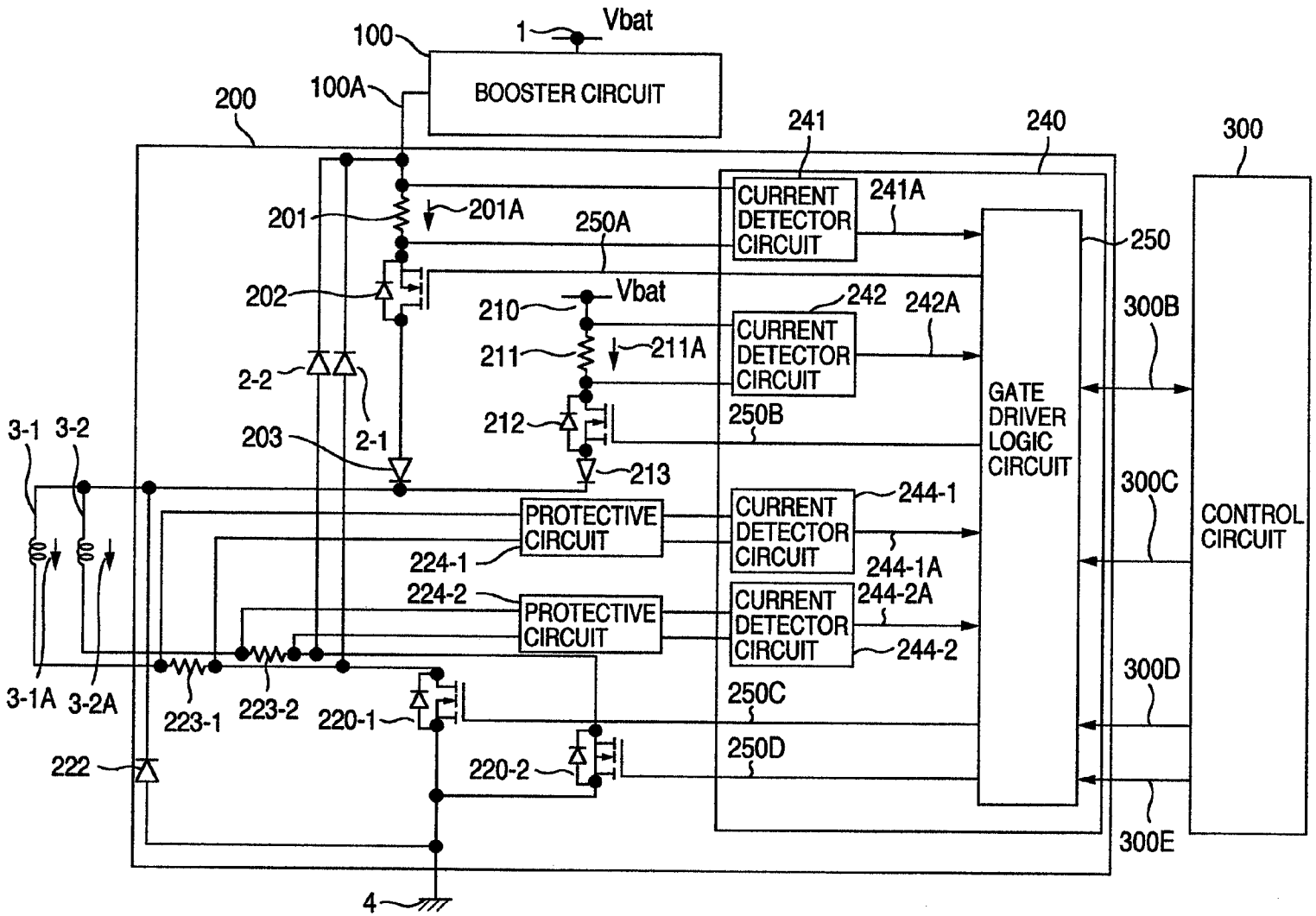
FIG. 4 is a diagram showing an injector driver circuit of the internal combustion engine controller according to the second embodiment of the present invention.

FIG. 4 shows the structure of an internal combustion engine controller according to the second embodiment of the present invention. The waveforms of typical signals are shown in FIG. 3.

In the second embodiment, the driver circuit 200 for driving the injectors 3-1 and 3-2 has a downstream side current detector resistor 223-1 of the injector 3-1 and a downstream side current detector resistor 223-2 of the injector 3-2, instead of the downstream side current detector resistor 221. These detector resistors 223-1 and 223-2 realize precise current control while the injector current 3-1A is reduced in a short time by regenerating electric energy of the injector 3-1 to the voltage booster circuit 100 via the current regeneration diode 2-1.

The downstream side current detector resistor 223-1 of the injector 3-1 is disposed between a drain electrode of the first downstream side driver FET 220-1 and one end of the injector 3-1. Similarly, the downstream side current detector resistor 223-2 of the injector 3-2 is disposed between a drain electrode of the second downstream side driver FET 220-2 and one end of the injector 3-2.

According to the circuit structure of the second embodiment, the injector currents 3-1A and 3-2A can be detected directly during the whole current exciting period. Accordingly, as compared to the first embodiment, it is not necessary to use the detection current select circuit 247 in the injector control circuit 240 in order to switch between the current detector circuits. The circuit structure can therefore be simplified.

A downstream side current detector circuit 244-1 for the injector 3-1 and a downstream side current detector circuit 244-2 for the injector 3-2 may be influenced by noises such as high voltage, reverse voltage, large current and static electricity. These circuits are directly connected to the injectors 3-1 and 3-2 disposed outside the internal combustion controller, and noises may enter the circuits directly. It is therefore preferable to provide necessary countermeasures.

For example, in this embodiment, there are provided a downstream side current detector protective circuit 224-1 for the injector 3-1 and a downstream side current detector protective circuit 224-2 for the injector 3-2, to thereby ensure protection from noises. If the influence of noises does not pose any problem of performance, it is not necessary to use the downstream side current detector protective circuit 224-1 for the injector 3-1 and downstream side current detector protective circuit 224-2 for the injector 3-2.

The waveforms of the embodiment are obtained through injector downstream side current detection (current pattern 1). According to the embodiment, the waveform of a first injector downstream side current detection signal 244-1A shown in FIG. 3 can be detected. The waveforms of the second embodiment shown in FIG. 3 are similar to those shown in FIG. 1, excepting that the current select circuit 247 of the first embodiment is not used.

Third Embodiment

Figure 5:
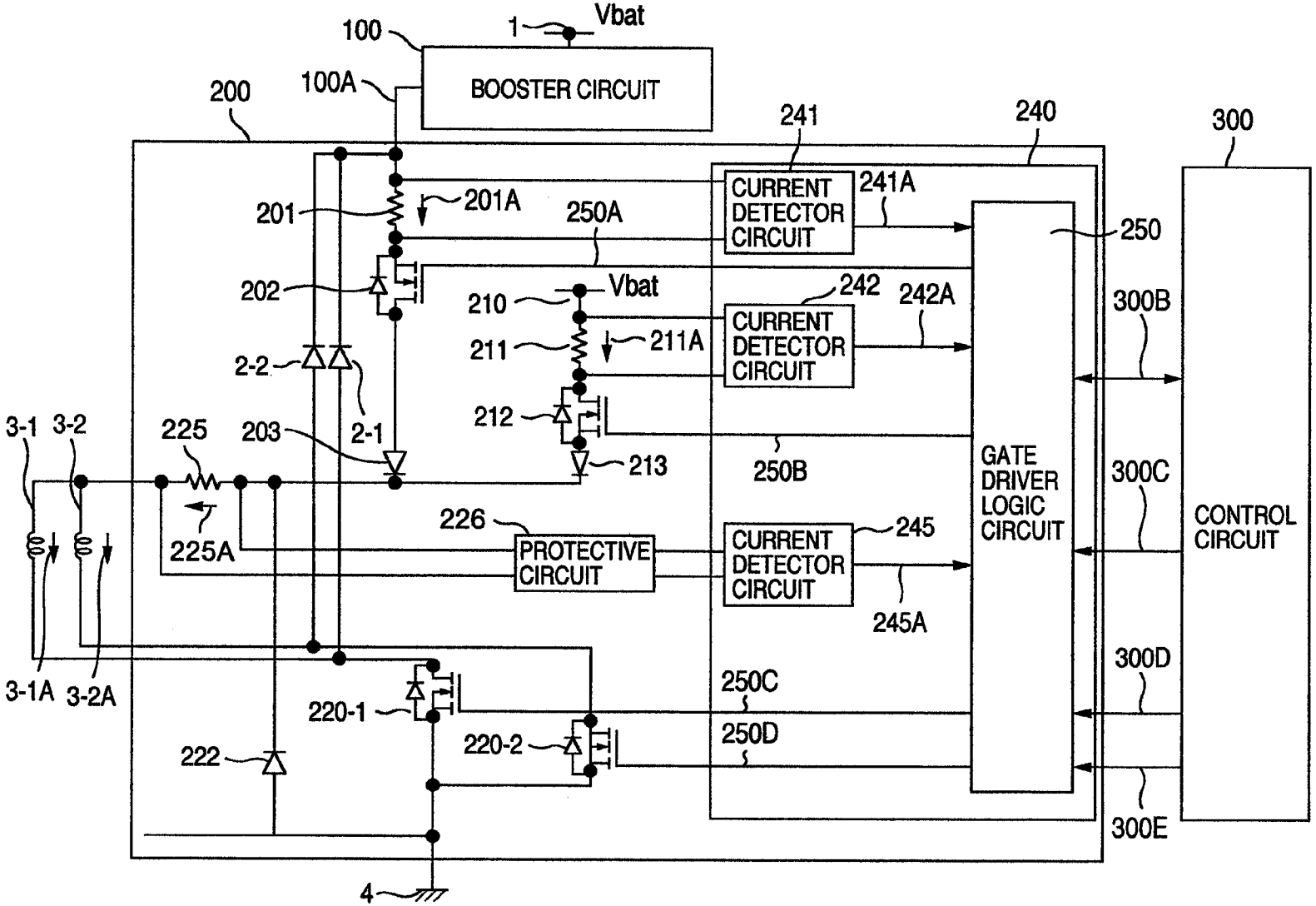
FIG. 5 is a diagram showing an injector driver circuit of the internal combustion engine controller according to the third embodiment of the present invention.

FIG. 5 shows the structure of an internal combustion engine controller according to the third embodiment of the present invention. The waveforms of typical signals are shown in FIG. 3.

In the third embodiment, the driver circuit 200 for driving the injectors 3-1 and 3-2 has an injector upstream side current detector resistor 225, instead of the booster side current detector resistor 201. This detector resistor 225 realizes precise current control while the injector current 3-1A is reduced in a short time by regenerating electric energy of the injector 3-1 to the voltage booster circuit 100 via the current regeneration diode 2-1. Therefore, the injector current 3-1A can be detected directly during the whole current exciting period by using one injector upstream side current detector resistor 201, as different from the first embodiment.

The injector upstream side current detector resistor 225 is disposed between one ends of the injectors 3-1 and 3-2 and both the booster side protective diode 203 and the cathode of the battery side protective diode 213. A current flowing through the injector upstream side current detector resistor 225 is detected with an injector upstream side current detector circuit 245, and sent to the gate driver logic circuit 250 as an injector upstream current detection signal 245A.

According to the circuit structure of the third embodiment, similar to the first embodiment, the injector currents 3-1A and 3-2A can be detected directly during the whole current exciting period. Accordingly, as compared to the first embodiment, it is not necessary to use the detection current select circuit 247 in the injector control circuit 240 to switch between the current detector circuits. The circuit structure can therefore be simplified.

An injector upstream side current detector circuit 245 may be influenced by noises such as high voltage, reverse voltage, large current and static electricity. These circuits are directly connected to the injectors disposed outside the internal combustion controller, and noises may enter the circuits directly. It is therefore preferable to provide necessary countermeasures.

For example, in this embodiment, there is provided an injector upstream side current detector protective circuit 226 to thereby ensure protection from noises. If the influence of noises does not pose any problem of performance, it is not necessary to use the injector upstream side current detector protective circuit 226.

The waveforms of the embodiment are obtained through injector downstream side current detection (current pattern 1). According to the embodiment, the waveform of an injector upstream side current detection signal 245A shown in FIG. 3 can be detected.

Fourth Embodiment

Figure 6:
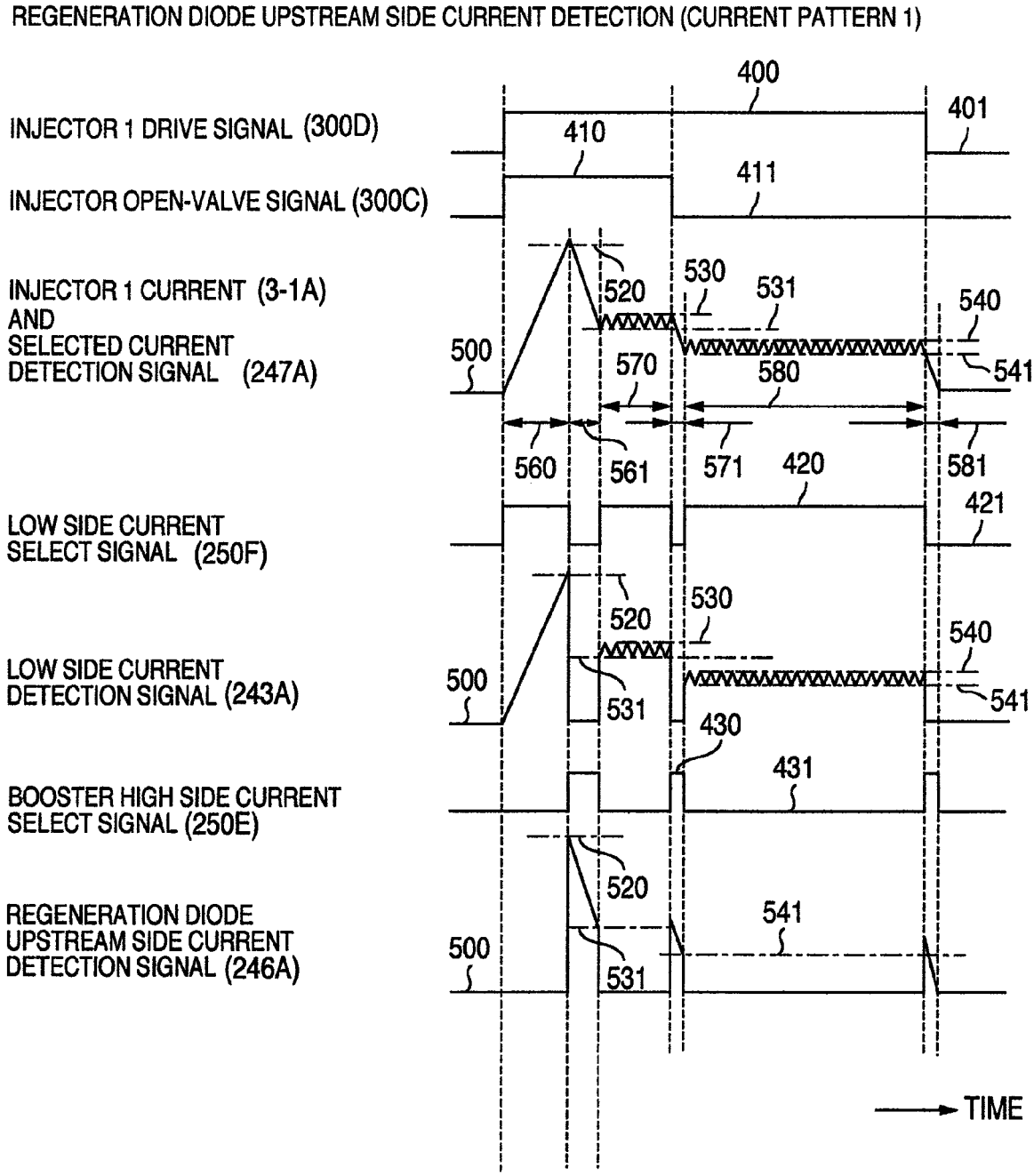
FIG. 6 is a diagram showing the current waveforms of an internal combustion engine controller according to a fourth embodiment of the present invention.
Figure 7:
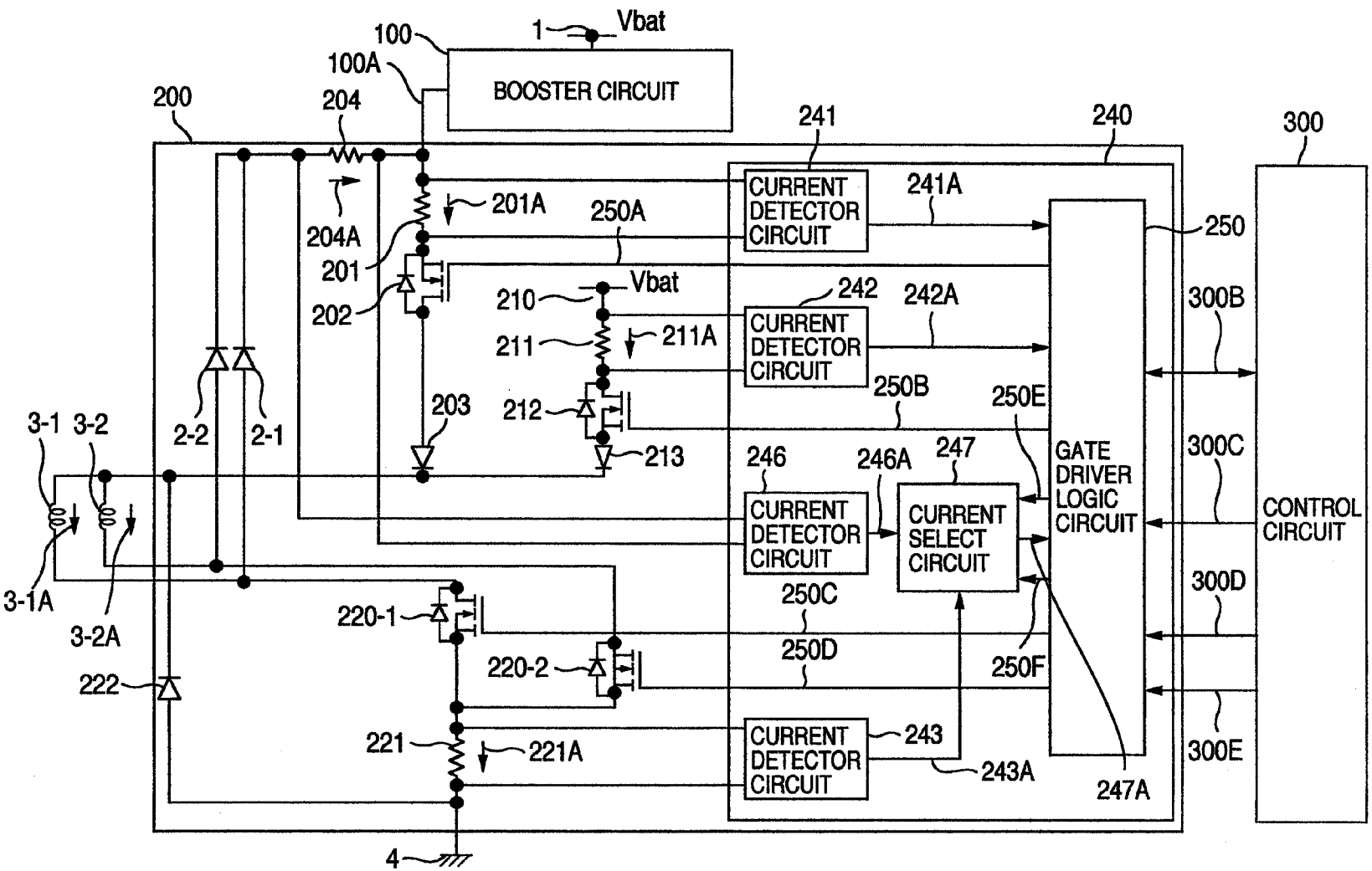
FIG. 7 is a diagram showing an injector driver circuit of the internal combustion engine controller according to the fourth embodiment of the present invention.

FIG. 7 shows the structure of an internal combustion engine controller according to the fourth embodiment of the present invention. The waveforms of typical signals are shown in FIG. 6.

In the circuit structure of the embodiment, the driver circuit 200 for driving the injectors 3-1 and 3-2 realizes precise current control while the injector current 3-1A is reduced in a short time by regenerating electric energy of the injector 3-1 to the voltage booster circuit 100 via the current regeneration diode 2-1.

To this end, in the embodiment, a regeneration diode upstream side current detector resistor 204 is provided, instead of the injector upstream current detector resistor 225 of the third embodiment. The regeneration diode upstream side current detector resistor 204 is disposed between the voltage booster circuit 100 and the cathodes of the current regeneration diodes 2-1 and 2-2.

A current flowing through the regeneration diode upstream side current detector resistor 204 is detected with a regeneration upstream side current detector circuit 246 which in turn outputs a regeneration diode upstream side current detection signal 246A to the gate driver logic circuit 250.

With this arrangement, even if regeneration currents to the voltage booster circuits are generated at the same time in a plurality of injectors driven by other circuit blocks 100 or even if a peak current and a regeneration current of the injector current using the voltage booster circuit 100 are generated at the same time, precise current control can be realized by switching between a low side current detection signal 243A output from a downstream side current detector circuit 243 and a booster high side current detection signal 246A output from a booster side current detector circuit 246, by using a detection current select circuit 247.

In this embodiment, a booster side drive current 201A is used for detecting an overcurrent outflowing from the booster circuit 100 and harness disconnection and the like on the side of the injectors 3-1 and 3-2.

Also in this embodiment, the waveforms are obtained through regeneration diode upstream side current detection (current pattern 1). In this embodiment, the waveform of an injector current 3-1A (selected current detection signal 247A) shown in FIG. 6 can be detected. A current to be detected with the current detector circuit 246 has a positive direction. Therefore, as different from the first embodiment, a regeneration diode upstream side current detection signal 246A takes a positive value. It is sufficient if the current detector circuit 246 can detect a positive current, and it is possible to use a simpler structure than that of the current detector circuit 241 of the first embodiment which is required to detect current of both positive and negative polarities.

As described so far, the present invention provides the internal combustion engine controller particularly suitable for driving cylinder direct injection type injectors for driving a load, by using a high voltage boosted from a battery voltage, the engine of the controller using gasoline, gas oil or the like as its fuel, such as those of automobiles, auto-bikes, agricultural tractors, machine tools, and marine vessels.

According to the above-described embodiments of the present invention, precise current control can be performed even during a period of reducing a current in a short time by regenerating electric energy of the injector 3-1 to the voltage booster circuit 100. Namely, current control of the injector current can be performed during the whole current exciting period.

According to the embodiments, the internal combustion engine controller can be realized without changing the structure and characteristics of a conventional injector driver circuit. Further, it is possible to reduce the number of components to be added for detecting a regeneration current to the voltage booster circuit 100.

The present invention has been described in connection with the preferred embodiments. The invention is not limited only to the above embodiments, but various modifications are possible without departing from the scope of appended claims.

The present invention is applicable to cylinder direct injection type injectors not only of the type using a solenoid as a work power and having electric inductance components but also of the type using a piezoelectric element as a work power and having electric capacitance components. The present invention is applicable to precise current control during the whole injector current exciting period including a period of regenerating energy to the voltage booster circuit.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An internal combustion engine controller comprising:

a voltage booster circuit for boosting a battery voltage and outputting a boosted voltage;

a first switching element disposed on an upstream side along a current direction of an injector, said first switching element flowing a current through said injector by using said boosted voltage;

a second switching element disposed on the upstream side along a current direction of said injector, said second switching element flowing a current through said injector by using said battery voltage;

a third switching element disposed on a downstream side along a current direction of said injector, said third switching element controlling a current flowing through said injector;

a first resistor disposed between said third switching element and a power source ground terminal, said first resistor detecting a current flowing through said injector;

a first diode for flowing a current from the downstream side to the upstream side of said injector;

a second resistor for detecting a current flowing via said first diode; and a driver control unit for controlling and driving said first, second and third switching elements based on a current detected by said first resistor and/or said second resistor.

2. The internal combustion engine controller according to claim 1, wherein:

a current flowing through said first resistor is detected during a first period while a current flows through said injector; and a current flowing through said second resistor is detected during a second period different from said first period.

3. The internal combustion engine controller according to claim 2, wherein said second resistor is provided between said voltage booster circuit and said first switching element.

4. The internal combustion engine controller according to claim 3, wherein:

an anode of said first diode is connected between said injector and said third switching element; and a cathode of said first diode is connected between said second resistor and said first switching element.

5. The internal combustion engine controller according to claim 2, wherein said first diode regenerates electric energy of said injector to said voltage booster circuit, when all of said first, second and third switching elements are turned off.

6. The internal combustion engine controller according to claim 2, wherein said driver control unit detects a current flowing through said injector during a whole period while a current flows through said injector, by using said first or second resistor.

7. The internal combustion engine controller according to claim 6, wherein said second resistor is used for detecting ground short and disconnection on the upstream side of said injector.

8. The internal combustion engine controller according to claim 2, wherein said driver control circuit controls the current flowing through said injector by using a current detected with said second resistor, when all of said first, second and third switching elements are turned off.

9. The internal combustion engine controller according to claim 8, wherein:

the internal combustion engine controller controls a plurality of injectors; and said first-resistor detects currents flowing through said plurality of injectors.

10. The internal combustion engine controller according to claim 2, wherein said driver control circuit controls the current flowing through said injector by using a current detected with said second resistor, during a peak current steep reduction period.

11. The internal combustion engine controller according to claim 2, wherein said driver control circuit controls the current flowing through said injector by using a current detected with said second resistor, during a hold current steep reduction period.

12. The internal combustion engine controller according to claim 1, wherein said driver control circuit comprises:

a first current detector circuit for detecting the current flowing through said first resistor;

a second current detector circuit for detecting the current flowing through said second resistor; and a current select circuit for selecting either a current detected with said first current detector circuit or a current detected with said second current detector circuit.

13. The internal combustion engine controller according to claim 1, further comprising a second diode connected between the upstream side of said injector and said power source ground terminal.

14. The internal combustion engine controller according to claim 13, wherein said second diode circulates regeneration current of said injector to be generated when said first and second switching elements are turned off and said third switching element is made conductive after a current is excited through said injector.

15. An internal combustion engine controller comprising:

a voltage booster circuit for boosting a battery voltage and outputting a boosted voltage;

a first switching element disposed on an upstream side along a current direction of an injector, said first switching element flowing a current through said injector by using said boosted voltage;

a second switching element disposed in parallel with said first switching element on the upstream side along a current direction of said injector, said second switching element flowing a current through said injector by using said battery voltage;

a third switching element disposed on a downstream side along a current direction of said injector, said third switching element controlling a current flowing through said injector;

a resistor serially connected to said injector, said resistor detecting a current flowing through said injector; and a driver control unit for controlling and driving said first, second and third switching elements, wherein said driver control unit has a current detector circuit for detecting a current flowing through said resistor during a whole period while a current flows through said injector.

16. The internal combustion engine controller according to claim 15, wherein a protective circuit is disposed between said resistor and said current detector circuit.

17. The internal combustion engine controller according to claim 15, wherein said resistor is disposed between said injector and said third switching element.

18. The internal combustion engine controller according to claim 15, wherein said resistor is disposed between said injector and an interconnection between said first and second switching elements.

19. A method of controlling a current flowing through an injector of an internal combustion engine, comprising:

in a first period, a step of flowing a peak current through said injector by turning on a first switching element and by using a boosted voltage obtained by making a voltage booster circuit boost a power supply voltage;

in a second period, a step of flowing a hold current through said injector by using a power source voltage, by performing on/off control of a second switching element; and in a third period, a step of flowing a regeneration current through said voltage booster circuit via said injector, by turning off said first and second switching elements, wherein:

a current flowing through a first resistor serially connected between said injector and a ground is detected during said first and second periods;

a current flowing through a second resistor serially connected between said injector and said voltage booster during said third period; and a period transits to said second period when a current detected with said second resistor reaches a predetermined value during said third period.

* * * * *